US005198606A

United States Patent [19]

Storstad et al.

[11] Patent Number: 5,198,606

[45] Date of Patent: Mar. 30, 1993

[54] AMMUNITION PRIMER HANDLING AND SHELL RELOADING SYSTEM

[75] Inventors: David J. Storstad, 225 Kings Pl., Newport Beach, Calif. 92663; Gary A. Nagy, Irvine, Calif.

[73] Assignee: David J. Storstad, Newport Beach, Calif.

[21] Appl. No.: 861,912

[22] Filed: Apr. 1, 1992

[51] Int. Cl.[5] ..... F42B 33/04

[52] U.S. Cl. ..... 86/32; 86/33; 86/37; 86/38

[58] Field of Search ..... 86/32, 33, 36, 37, 38

[56] References Cited

U.S. PATENT DOCUMENTS

| | | | |
|---|---|---|---|
| 57,258 | 8/1866 | Powers | 86/32 |
| 221,971 | 11/1879 | Murry | 86/36 |
| 240,539 | 4/1881 | Powers | 86/36 |
| 343,836 | 6/1886 | Murphy | 86/36 |
| 374,482 | 12/1887 | Lee | 86/36 |
| 605,339 | 6/1898 | Place | 86/36 |
| 711,231 | 10/1902 | Robinson | 86/36 |
| 716,797 | 12/1902 | Wesson | 86/36 |
| 1,398,106 | 11/1921 | McGee | 86/23 |
| 2,013,850 | 2/1936 | Peterson | 86/27 |
| 3,152,508 | 10/1964 | Fratila | 86/38 |
| 3,240,103 | 3/1966 | Lamont | 86/38 |
| 3,408,892 | 11/1968 | Smith et al. | 86/23 |
| 4,027,781 | 6/1977 | Covert | 86/37 |
| 4,163,410 | 8/1979 | Dillon | 86/23 |
| 4,343,222 | 8/1982 | Dillon | 86/27 |
| 4,429,610 | 2/1984 | Mantel | 86/36 |
| 4,542,677 | 9/1985 | Lee | 86/38 |

*Primary Examiner*—J. Woodrow Eldred

*Attorney, Agent, or Firm*—Knobbe, Martens, Olson & Bear

[57] ABSTRACT

The present invention is an apparatus for installing primers in ammunition shells, comprising a primer holder having walls defining a pocket opening to an upper surface of the holder for receiving a primer. The pocket has a diameter slightly smaller than the diameter of a primer so that there is an interference fit between the pocket and the primer sufficient to prevent the primer from being inadvertently dislodged from the holder during shipment, handling or use of the holder. The holder has a hole extending from a bottom of the pocket to a bottom surface of the holder for receiving a pin which pushes the primer out of the pocket and directly into a shell in response to relative movement between the holder and the pin. The holder preferably is disk shaped and has a plurality of pockets. The invention further comprises a shell reloading machine which utilizes the new primer feed system.

25 Claims, 8 Drawing Sheets

AMMUNITION PRIMER HANDLING AND SHELL RELOADING SYSTEM

FIELD OF THE INVENTION

The invention relates generally to ammunition shell reloading systems and, more specifically, to a system for safely and efficiently handling ammunition primers during shipping and throughout the shell reloading process.

BACKGROUND OF THE INVENTION

For those who regularly fire rifles or pistols, the cost of ammunition is an expensive consideration. Practice sessions for law enforcement personnel, military units, or avid sportsmen commonly involve firing hundreds of rounds. As any gun enthusiast well knows, ammunition is not cheap and can be expended fairly rapidly, especially if using a semi-or fully-automatic weapon. The exorbitant cost of new ammunition combined with its inherent wastefulness inevitably points to a need for systems which reuse the spent shells.

As seen in FIG. 1, a small-arms (pistols and rifles) round generally comprises three sections: a bullet 20, a shell 22 and a primer 24. The bullet 20 is the eventual projectile and as such has a blunt conical, aerodynamically streamlined shape. Commonly, bullets are expendable and have an outer metal jacket with an inner core of a lead alloy for greater mass. The shell 22 is a hollow cylinder with an open end sized to hold tight the trailing end of the bullet 20 when press-fit around it. Gun powder 26, or other similar propellant, fills the interior of the shell 22. A small flash hole 28 in the center of the closed end of the shell leads to a primer socket 30. The primer 24 comprises a small metal cup 32 partially filled with a combustible composition 34. A anvil 36 partially covers the combustible composition 34 within the primer 24. The primer 24 is forced into the socket 30 in the shell 22 so that the combustible composition 34 is proximate the flash hole 28, and the bottom of the metal cup 32 is flush with the closed end of the shell. The closed end of the shell includes a rigid base 35 with a flange 37 for gripping during reloading.

When a pistol or rifle is fired, a hammer strikes the exposed end of the primer in the shell, forcing the anvil to compress and ignite the combustible composition. The primer composition undergoes a fast, controlled burn which in turn ignites the main propellant via the flash hole. The shell is commonly made of brass and is manufactured softer in the middle portion which allows that portion to expand under the combustion forces of the burning propellant and grip the inside of the gun barrel. All of the remaining energy from the propellant combustion is transferred to the trailing end of the bullet, sending it out the open end of the gun barrel. The spent primer remains wedged in the end of the shell which is commonly ejected from the gun automatically, or upon recocking. The shell can then be retrieved and a new primer, propellant and bullet added to produce a recycled ready-for-use round.

Machines for reloading shells have been known for many years. Most of the machines are classed into one of two groups depending on the number of shells handled. Single-stage machines can perform all the necessary reloading functions, one at a time. In other words, one function is performed for a number of shells before a second function is performed on the same shells. Alternatively, one shell is reloaded completely in a single-stage machine before a second is inserted. Conversely, progressive machines perform multiple operations on different shells at once. This type of machine works like an assembly line with a moving carriage shifting the shells from one step to the next until finally reloaded. Both types of reloading machines require a large amount of manual assistance, creating numerous opportunities for tragic mishaps, due to the danger of extensive handling of explosives.

The primers, in particular, are handled extensively in prior art machines and contain an extremely volatile chemical. Traditionally, a box of primers, packed by the manufacturer, is dumped into a pan which is shaken to cause the primer cups to orient themselves with their open ends up. The primers are then inserted by hand into long tubes which serve as feed mechanisms for the reloading machines One by one, the primers are extracted from the lower end of the tubes and transferred to a position under a de-primed shell. This movement intensive path from shipping container to shell creates many opportunities for the primers to be inadvertently detonated. The feed tube becomes a virtual bomb if one primer is stacked wrong and detonates, causing sympathetic detonation of multiple primers Accidental explosions occur regularly considering the number of gun owners in this country and there is a dire need for a system designed to eliminate the hazards surrounding primer handling and reloading.

There are other deficiencies inherent in the prior art primer handling systems. One or more primers may be misaligned within the feed tube causing the primers to be subsequently forced into the ammunition shell at an angle. Upon firing of the gun, the primer may actually explode in an uncontrolled combustion, resulting in possible injury to the operator. The feed tubes are opaque and mask the number of primers within.

It is common for avid sportsmen to experiment with primers of different kinds to achieve a particular performance. Primers are manufactured by numerous companies in three sizes (0.175", 0.210" and 0.211"), with two different types and/or amounts of combustible material for pistols and rifles, and with either a standard or magnum classification. The feed tubes are cumbersome when a variation of primer is desired. Either the feed tube has to be emptied and refilled, or multiple feed tubes are required, adding to the cost.

Typical prior art containers used to ship primers comprise a plastic rack with 100 (10 rows, 10 columns) apertures designed to loosely hold primers. The primers are kept apart from one another to comply with federal transportation safety codes. However, the geometry of these prior shipping containers dictates that the primers in the middle rows disadvantageously have eight adjacent primers in close proximity. If, by some accidental or negligent circumstance, one of the middle primers detonated, the chances are good for a sympathetic detonation of one of the adjacent primers.

Another potentially serious, but certainly more exasperating, drawback of shipping containers of the prior art is seen in their lack of retaining means to prevent primers from spilling once the outer cardboard cover is removed. The primers rest in the apertures loosely, and the plastic rack is easily overturned, causing the primers to fall out. In fact, the rack is specifically designed to allow the primers to be emptied easily into an orienting tray for subsequent loading into a reloader feed tube or other feed mechanism. Primers may detonate on hitting an object or the ground or if stepped on, causing injury.

Also, due to the multitude of types of primers, and their similar appearance, loose primers are essentially lost. A typical sportsman may have primers of several types laying about the reloading shop area, and distinguishing one from the other is a time-consuming and arduous task. Even after identifying a particular primer, it most likely has acquired dust and/or oil from the environment, possibly resulting in a diminished, or otherwise unpredictable, detonating performance.

Primer feed mechanisms which accept a plurality of loose primers and dispense them one by one are prevalent. Included in this category are U.S. Pat. Nos. to Lee (374,482), Place (605,339), Peterson (2,031,850), Smith et al. (3,408,892), Dillon (4,163,410 and 4,343,222), Mantel (4,429,610) and Lee (4,542,677). The feeders may be stacks, rotary channels, arcuate channels or funnel-like structures. In all these devices, the primers move relative to the feeders. Additionally, all of the primer feeders of the prior art require the primers to be removed from the shipping container and manually aligned before insertion into the feeder. Disadvantageously, primer reloaders of the prior art require a substantial number of structural parts involved in mounting the feed container and transferring the primer from the feed container to the shell. In addition, prior art reloaders have two push pin assemblies for the two sizes of primers (0.175 and 0.210 inch), which have to be interchanged when switching to a new primer size.

SUMMARY

The present invention overcomes the drawbacks of the prior primer feeding systems by retaining the primers within stationary pockets formed in a rigid holder from the point of manufacture until a tool presses them into a de-primed shell. The present invention also provides an improved shell reloading machine which utilizes the new primer feed system, and provides several other advantageous features.

The present invention is an apparatus for installing primers in ammunition shells, comprising a primer holder having walls defining a pocket opening to an upper surface of the holder for receiving a primer. The pocket has a diameter slightly smaller than the diameter of a primer so that there is an interference fit between the pocket and the primer sufficient to prevent the primer from being inadvertently dislodged from the holder during shipment, handling or use of the holder. The holder has a hole extending from a bottom of the pocket to a bottom surface of the holder for receiving a pin which pushes the primer out of the pocket and directly into a shell in response to relative movement between the holder and the pin.

Preferably, the holder includes a plurality of the pockets, and includes a mechanism cooperating with the holder for sequentially moving the holder to move the pockets in alignment with the pin. The mechanism includes a finger which enters into the hole and engages a side wall to apply a force for moving the holder In a further aspect, the invention includes an ammunition shell receiver positioned above and aligned with the pocket and a linkage for raising and lowering the receiver. The holder moving mechanism is responsive to movement of the linkage to move the holder in coordination with movement of the receiver.

The holder of the present invention is disk shaped and provided with a plurality of the pockets spaced from each other. The holes through the bottom of the pockets taper outwardly in a downwardly direction towards the holder bottom surface so as to facilitate alignment of the holder with the pin.

The primer replacing apparatus includes a support table with a support shaft extending upwardly from the table. A platform mounted on the shaft and spaced above the table supports the holder. A spring around the support shaft urges the platform upwardly a distance from the table. A pin mounts in the table and extends upwardly to be axially aligned with one of the pockets. A shell receiver for receiving the base of a shell of a round of ammunition is positioned above the holder with a primer receiving opening in the shell being positioned above and axially aligned with one of the pockets and the pin.

A further aspect of the primer replacing apparatus comprises means for moving the shell receiver downwardly into engagement with the primer holder, causing the primer holder to be moved downwardly against the urging of the spring. One of the holder pocket holes is thus moved onto the pin so that one of the primers is pushed out of its pocket and into an opening in the base of a shell positioned in the shell receiver.

Additionally, a piston supports the shell receiver, and a lever and linkage mechanism raises the piston to a position wherein a primer removal pin enters an open upper end of the shell to push a spent primer downwardly and outwardly of the shell. The piston is further movable downwardly by means of the lever and linkage to lower the shell into engagement with and depress the primer holder to cause a primer to be pushed out of one of the pockets by the pin and into the shell.

In accordance with a further aspect, the primer replacing apparatus includes means responsive to the reciprocating movement of the piston to rotate the disk in sequential steps to position one of the pockets axially aligned with the pin and the primer opening in a shell positioned in the shell receiver Advantageously, the piston contains a spent primer chamber, including an inlet chute. The chute is normally urged open but is pushed closed by the holder when the piston is in a lowered position. The inlet and the chute are aligned beneath the shell receiver so that when the piston is elevated to the position where a spent primer is being ejected from the shell, the ejected primer will fall into the chute and be deposited within the chamber.

The present invention also includes a procedure of positioning a plurality of primers in pockets in a primer holder with each primer being positioned in its own pocket which is isolated from the other primers. Each primer is thus held securely within its pocket during shipment. The procedure further includes positioning the holder on a support with a shell base receiver positioned above one of the pockets. A shell is positioned in the receiver so that a primer receiver opening in the shell is aligned with a primer in one of the pockets. One of the primers is pushed out of its pocket and into the primer receiving opening so that the primers may directly be shipped in the holder and dispensed into a shell.

In a further step of the procedure, the shell receiver is elevated before the movement producing step into a position wherein a spent primer in a shell carried by the receiver is pushed downwardly out of the shell. Lowering the shell receiver, together with shell to engage the primer holder and depress it to a depressed position pushes a new primer out of the holder into the shell. The holder is allowed to move upwardly from the depressed position in response to the urging of a spring.

The holder is automatically advanced in response to movement of the receiver to a position wherein a second primer in the holder is aligned with the shell receiver. A further step includes automatically opening a chute beneath the shell receiver to capture the spent primer being pushed from the shell. The chute is aligned to direct the spent primer into a chamber within a piston supporting the receiver.

The procedure includes sequentially rotating the disk shaped holder to position the pockets beneath the shell receiver to install each of the primers into a shell. Advantageously, the holder is rotated automatically in response to movement of the shell receiver in connection with an additional shell reloading operation.

DETAILED DESCRIPTION OF THE DRAWINGS

Figure 1:
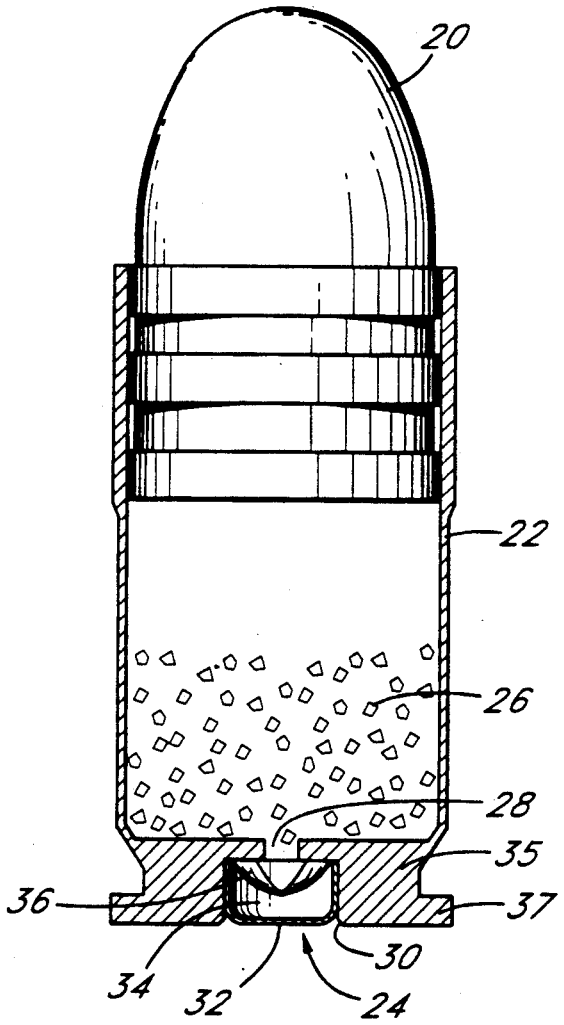
FIG. 1 is a sectional view of a typical small-arms ammunition round showing the primary components.
Figure 2:
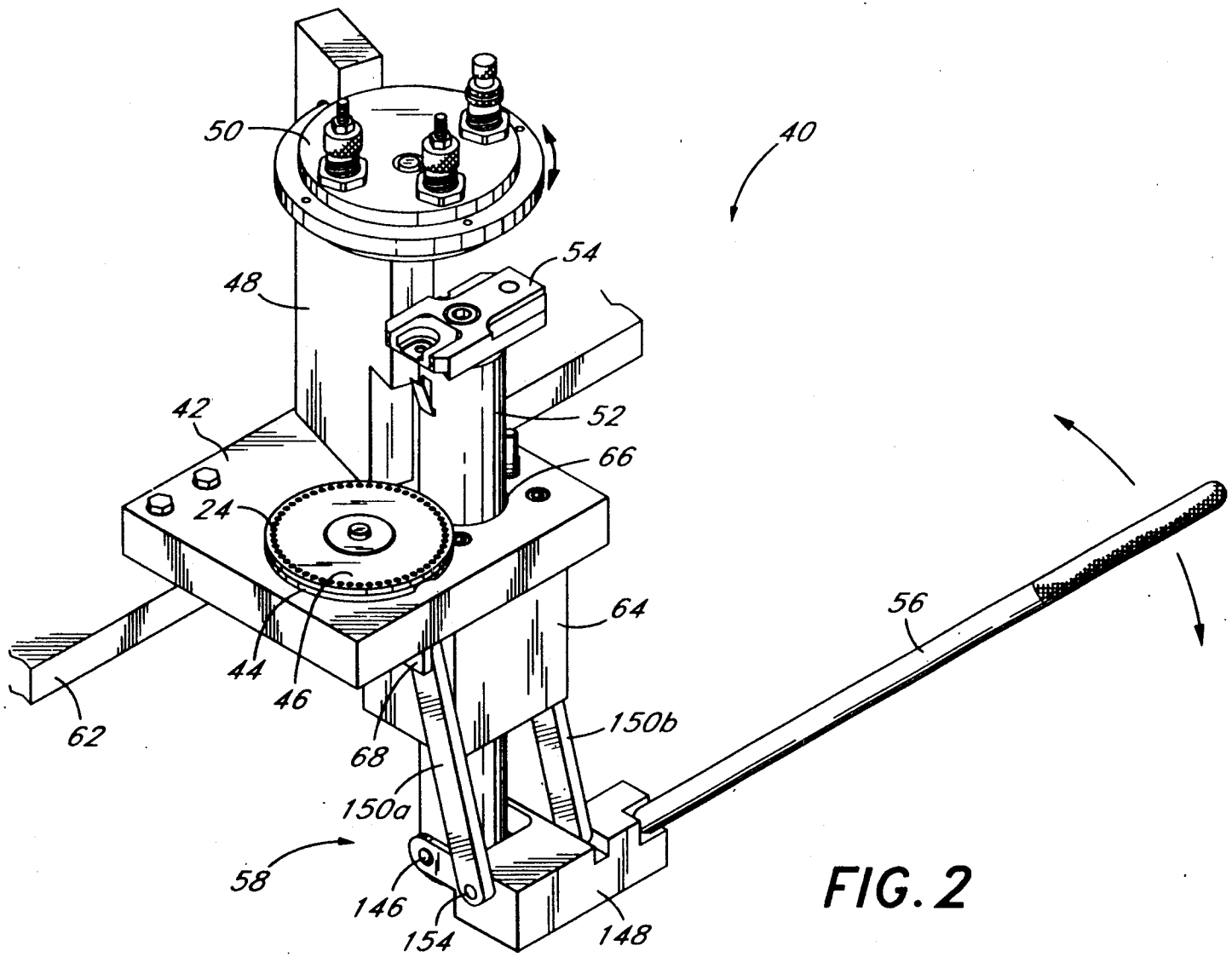
FIG. 2 is a perspective view of the cartridge reloading system showing the improved primer holder.

Referring to FIG. 2, the improved shell reloading machine 40 of the present invention generally comprises a support table 42, a platform 44 disposed above the support table, a primer holder 46 resting on the platform, a support column 48 fixed to the support table, a tool plate 50 mounted at the top of the support column, a hollow piston 52 extending through the support table, a shell plate 54 affixed to the upper end of the piston, and an operating lever 56 connected to the piston via a linkage mechanism 58. The shell plate 54 at the top of the piston 52 is driven vertically between the tool plate 50 and the support table 42 by means of the operating lever 56. Obscured from view in FIG. 2 is a primer holder indexing mechanism 60 as shown FIGS. 8*a* through 8*c*.

A slab of high-strength material acts as the rigid support table 42 and bolts to a stationary base 62. The support table 42 extends over the edge of the base 62 to allow room for the movement of the piston 52 and linkage mechanism 58. The rigid support column 48 extends upward from the right rear corner of the support table. A cylinder housing 64 depends from the front lower side of the support table 42 below the surface of the base 62. A cylinder 66 passes through the top of the support table 42 to the lower end of the housing 64. The cylinder 66 receives the piston 52 for sliding engagement with a minimum of clearance to ensure concentricity.

Figure 3:
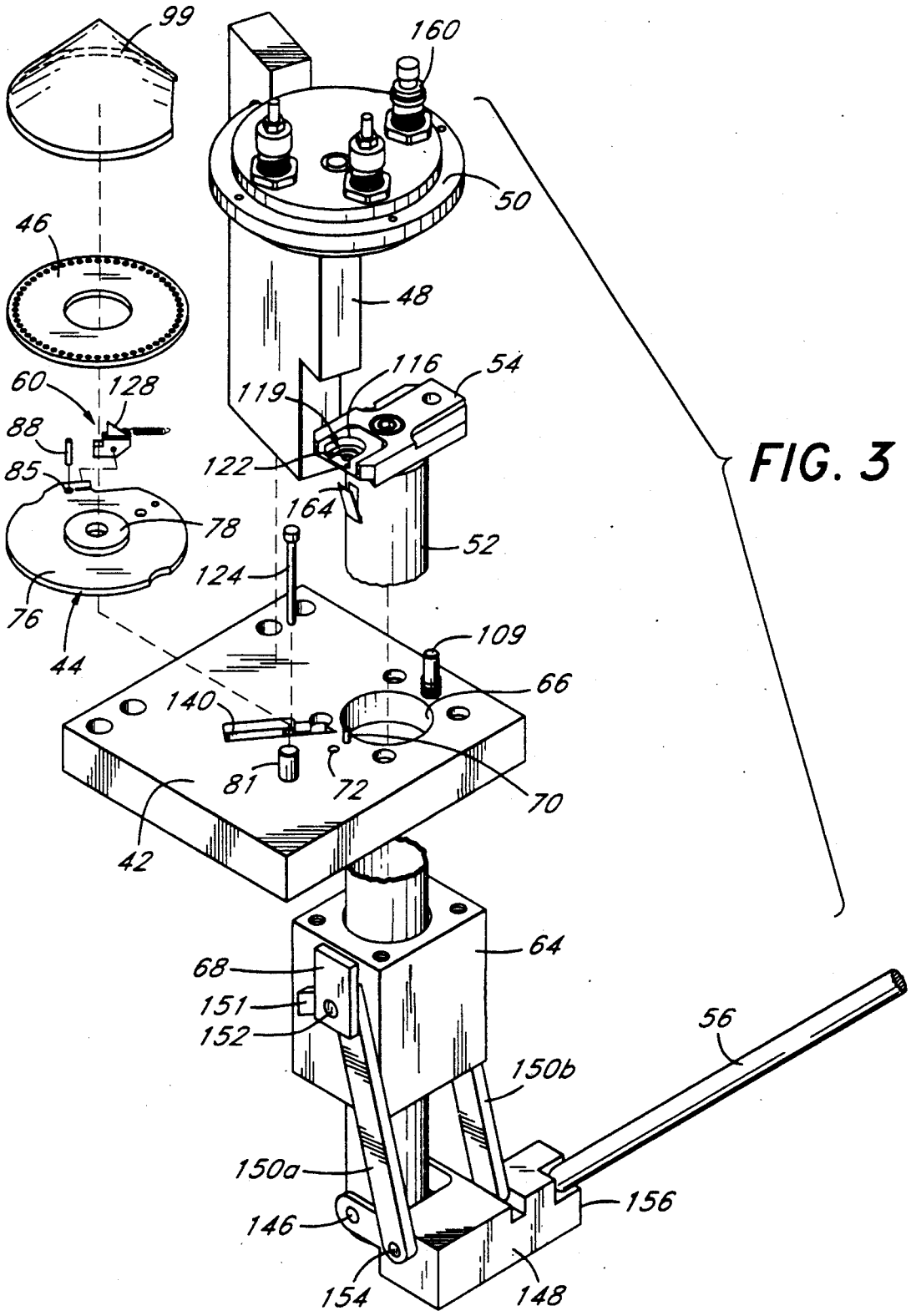
FIG. 3 is an exploded view of the cartridge reloading system.

As seen in FIGS. 2 and 3, two parallel linkage hinges 68 are fixed to the bottom of the support table 42 on either side of the cylinder housing 64. A pusher pin 70 projects upwards from the top surface of the support table 42 proximate the cylinder opening 66. The pusher pin 70 preferably screws into a threaded hole in the table 42 for ease of replacement. A platform guide hole 72 in the table 42 proximate the pusher pin 70 receives a shaft 74 (see FIGS. 6 and 7) of the platform 44.

A straight line may be drawn connecting the centers of the pusher pin 70, piston 52, and shaft 74. As will be apparent in the discussion of the operation of the reloader 40, a shell 22 inserts into the shell plate 54. The shell plate 54 on the piston 52 imparts a downward force on the platform 44 and shaft 74 to bring the shell 22 down over the pusher pin 70. The alignment of the pusher pin 70, piston 52, and shaft 74, ensures the platform 44 will not be cantilevered to one side or the other which could affect the proper seating of the primer 24 into the shell 22. In addition, the proximity of the shaft 74 to the pusher pin 70 provides the sliding support for the platform 44 as close as possible under the point of force application, minimizing tilting toward the piston 52.

Figure 4:
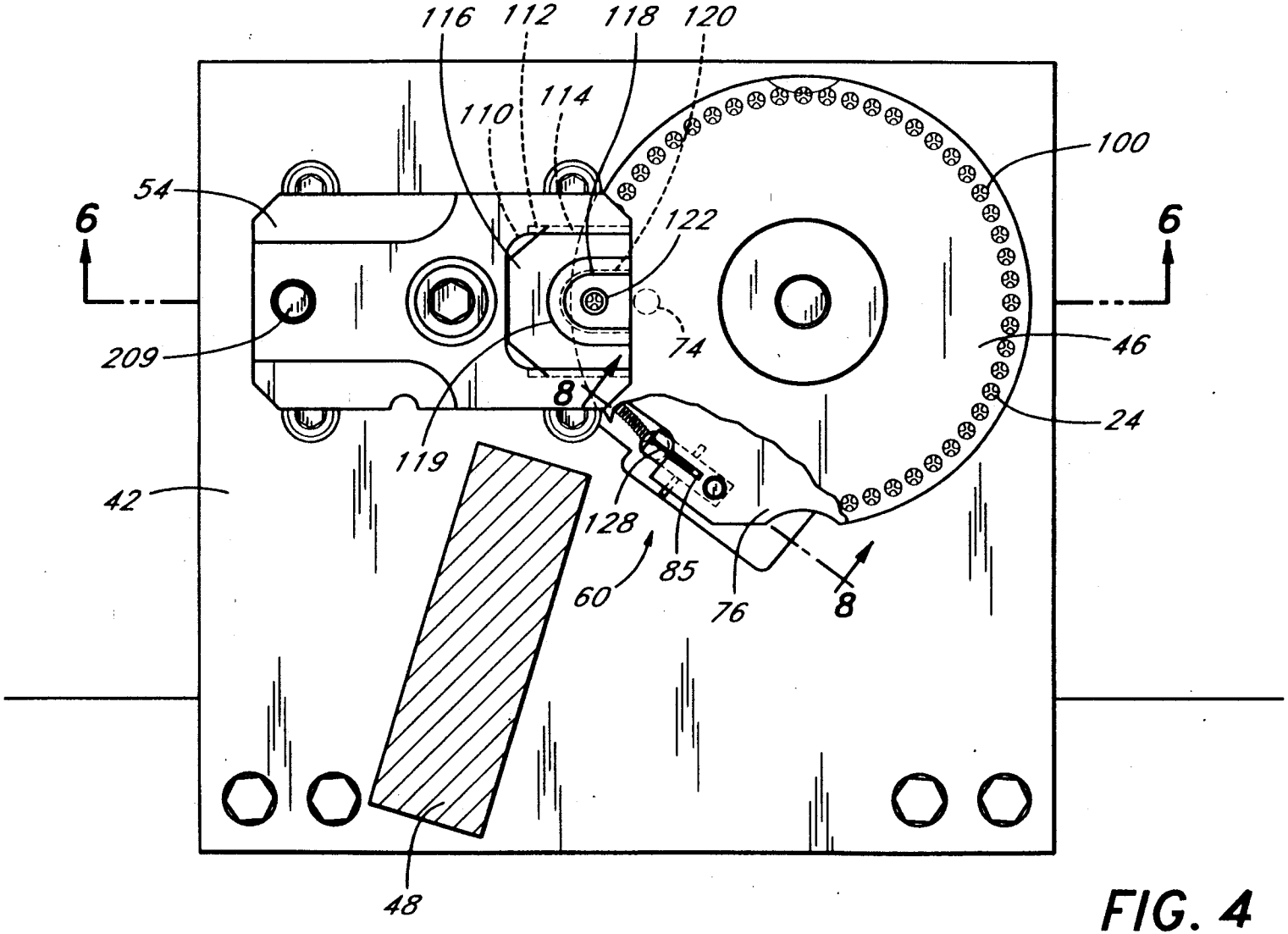
FIG. 4 is a top plan view of the cartridge reloading system showing the alignment of the primer holder under the shell plate.

Referring to FIGS. 3 and 4, the platform 44 generally comprises a rigid disk 76 with a raised circular hub 78 on the top surface. The hub 78 centers a primer holder 46 on the platform 44. A portion is removed from a side of the platform disk 76 adjacent the piston 52. The removed portion of the platform 44 exposes the indexing mechanism 60 mounted in the support table 42. A slot 85 cut into the platform disk 76 receives a pivoting index finger 128 of the indexing mechanism 60 under the primer holder 46.

Figures 5, 6:
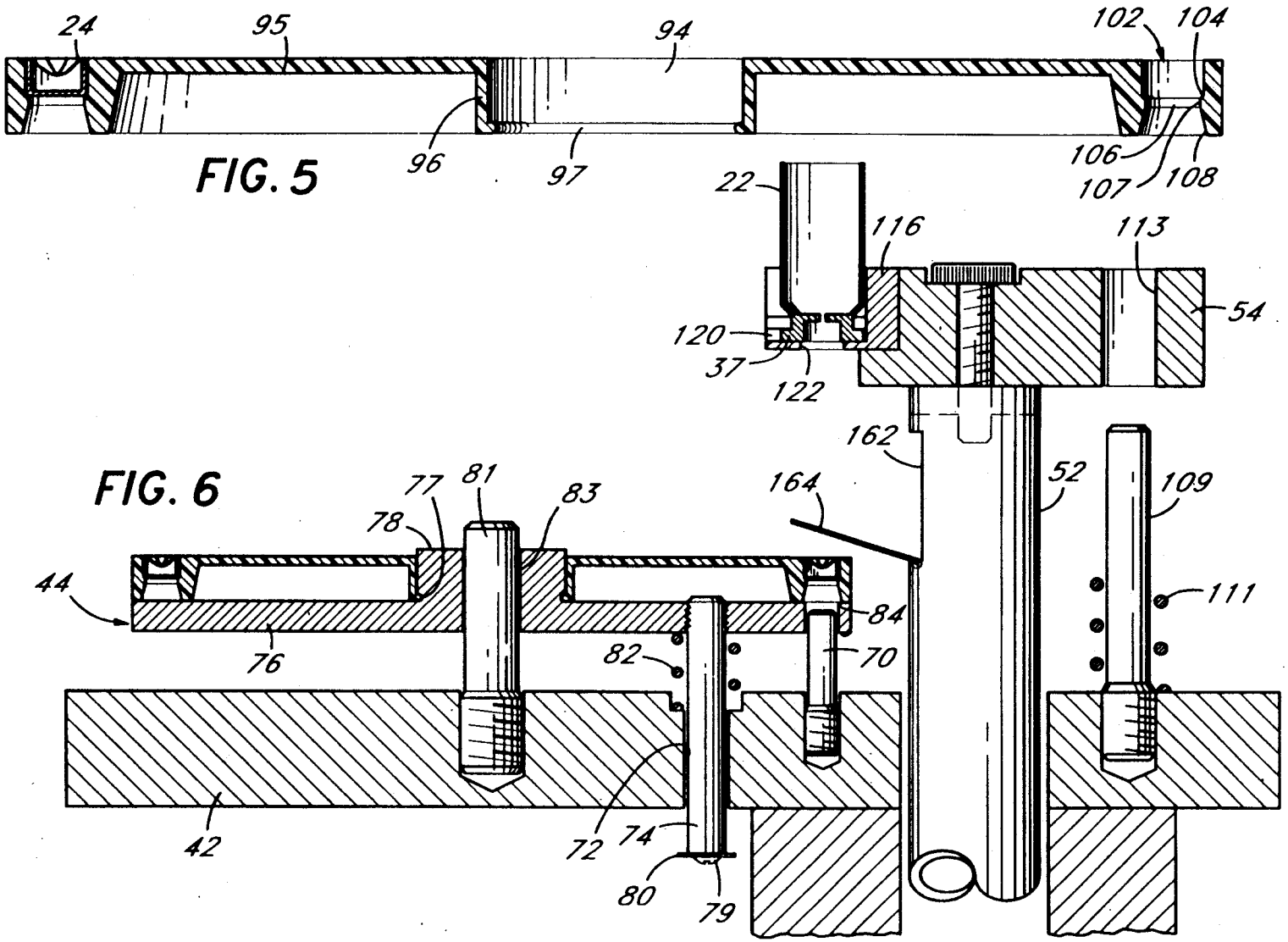
FIG. 5 is an enlarged cross-sectional view of the cartridge holder of the present invention.
FIG. 6 is a cross-section along lines 6—6 of FIG. 4 showing the cartridge holder in a neutral position above the support table.
Figure 7:
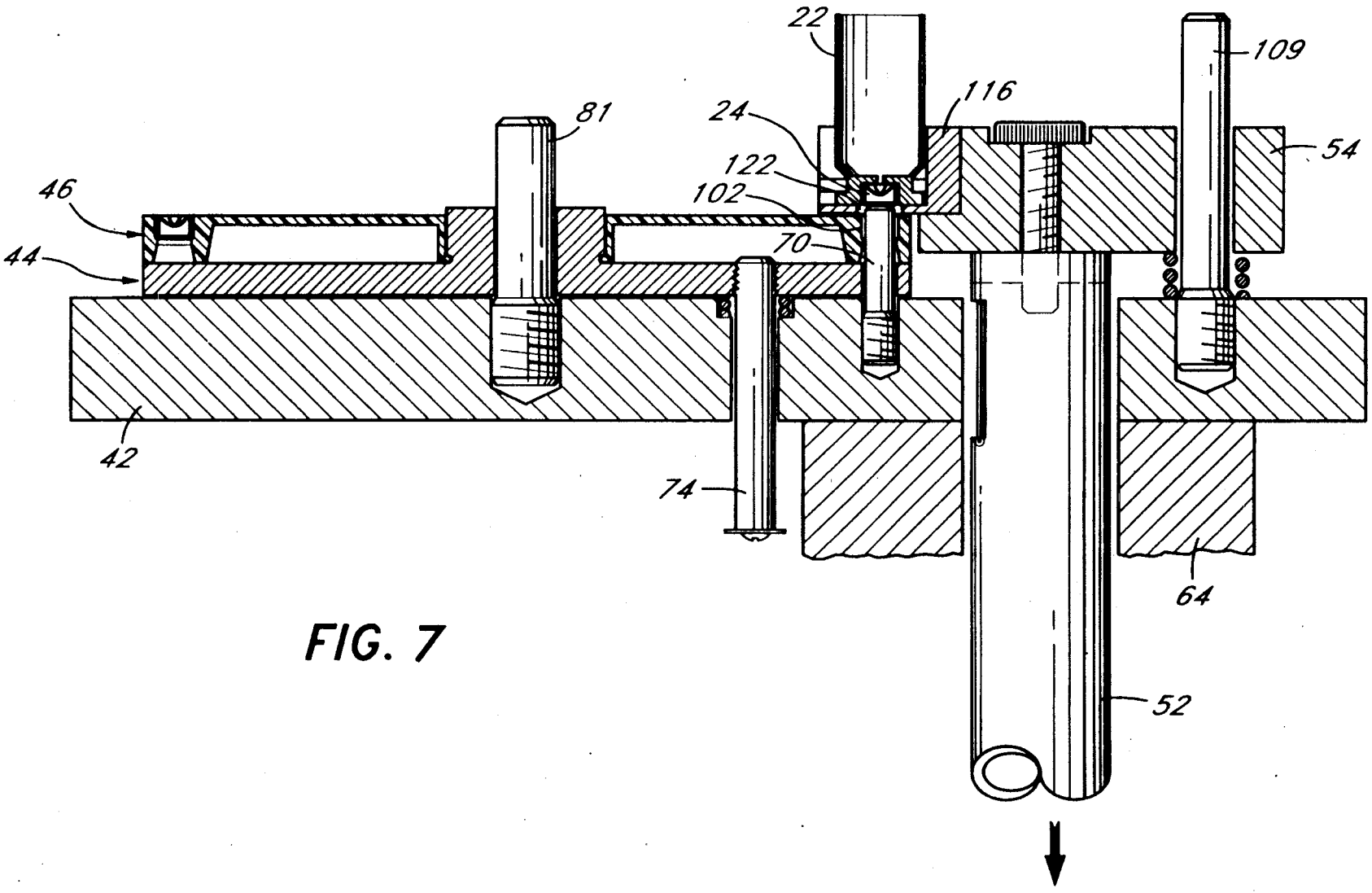
FIG. 7 is a cross-section along lines 6—6 of FIG. 4 showing a primer being pushed into the bottom of a cartridge.

Referring now to FIG. 6 and 7, the support shaft 74 mounted to the platform 44 depends from the lower face of the platform proximate the side closest to the piston 52. The shaft 74 extends into the platform guide hole 72 in the support table 42 in a close sliding fit and extends below the table. A spring 82 disposed around the shaft 74 biases the platform 44 upward away from the support table 42. A nut 79 and washer 80, mounted to the lower end of the shaft 74 restricts further upward motion of the platform 44. A stanchion 81, mounted vertically to the support table 42, closely slides in a central aperture 83 in the platform 44 so that the platform is held substantially horizontal as it descends. A through-hole 84 at the edge of the platform 44 nearest to the piston 52 receives the pusher pin 70 when the platform is pushed down to contact the support table 42, and the shaft 74 slides downward in the guide hole 72. The pusher pin 70 normally resides within the through-hole 84 without extending above the top surface of the platform 44. As the platform 44 descends, the pusher pin 70 projects above the top surface of the platform.

Figure 8A:
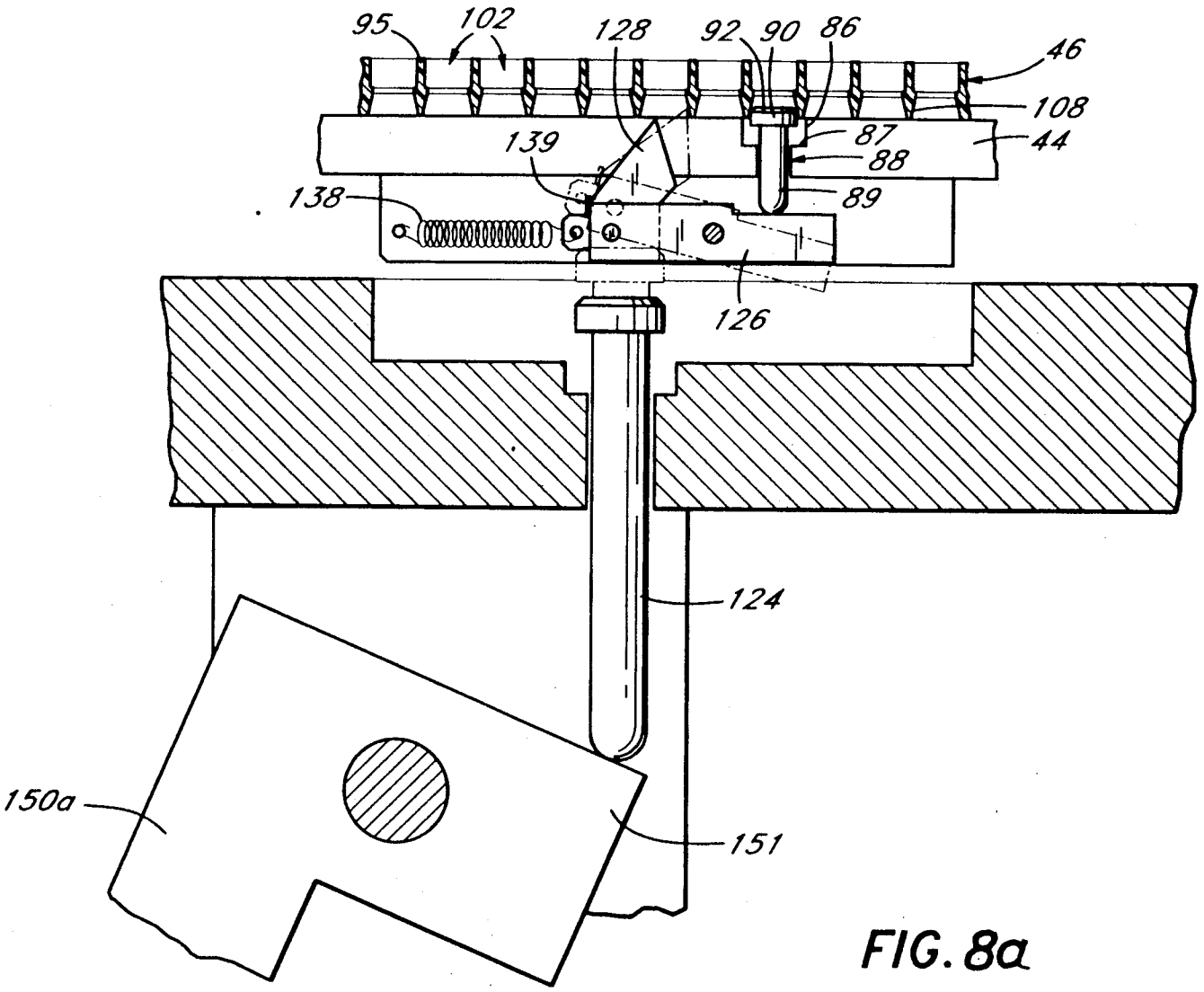
FIG. 8*a* is an elevational view of the preferred indexing mechanism taken along line 8—8 of FIG. 4.
Figures 8B, 8C:
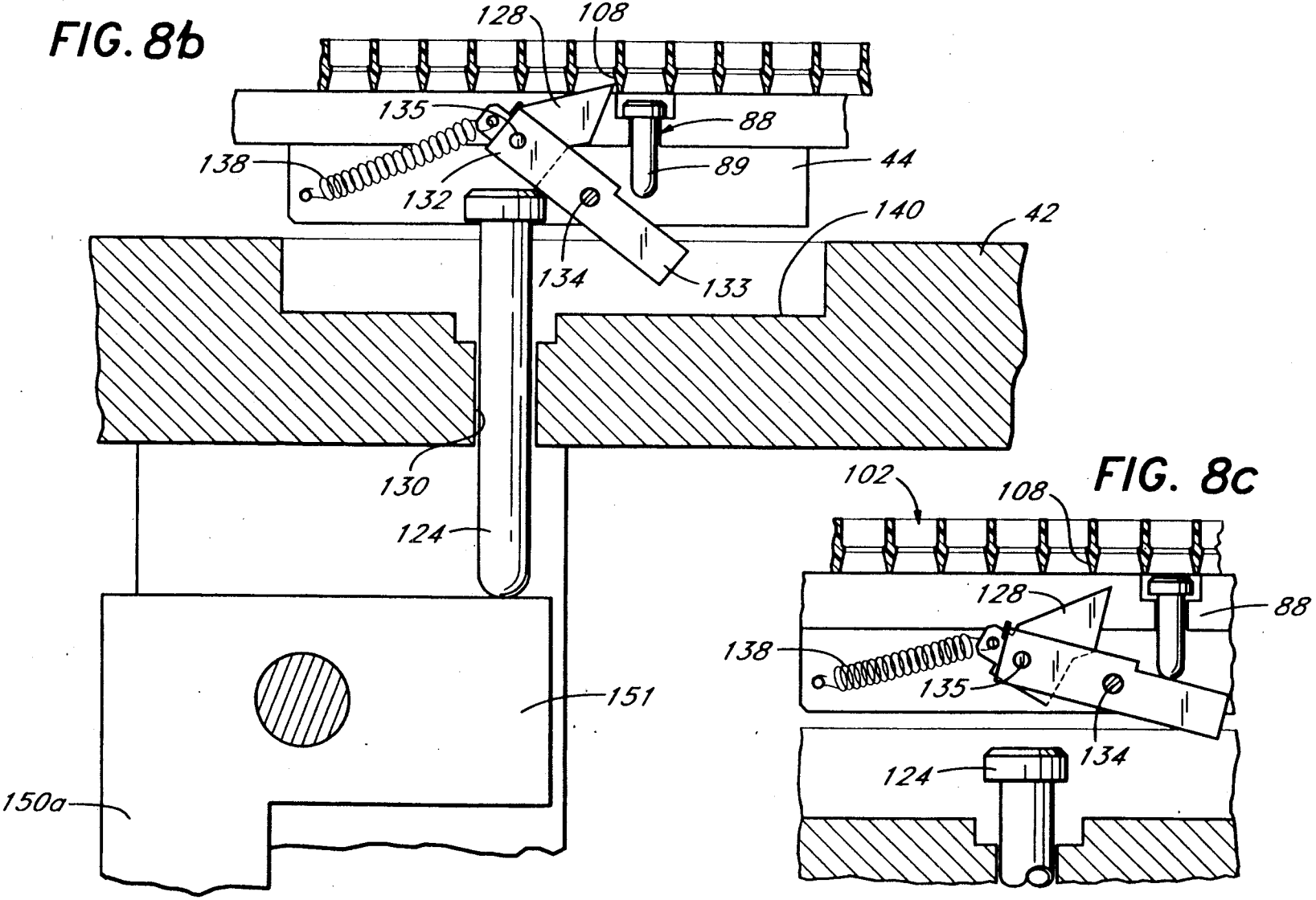
FIG. 8*b* is an elevational view of the indexing mechanism shown just after rotating the primer holder.
FIG. 8*c* is a detail of the pivoting index finger of the indexing mechanism.

As seen in FIGS. 8*a*–*c*, a cylindrical channel 86 in the platform 44 receives a positive lock pin 88. The lock pin 88 comprises a lower shaft portion 89 and an upper head 90 of larger diameter than the shaft portion. The shaft 89 inserts into the channel 86 until the head portion 90 rests on a shoulder 87 formed by a reduction of diameter of the channel approximately mid-way down through the platform 44. The lock pin 88 thus can rest with its head 90 below the top surface of the platform 44. The channel 86 passes through the platform 44 so that the shaft 89 may extend out the bottom. The head 90 comprises a chamfered portion 92 at the top. The chamfer 92 acts as a camming surface to facilitate a rough primer holder 46 alignment upon upward motion of the pin 88 and, conversely, downward lock pin motion upon sliding movement of the primer holder. The positive lock pin 88 comprises one means for securing the primer disk 95 from freely rotating between rotation steps. Other means such as a cantilevered wire spring acting on the primer disk 95, or a plastic spring mating with a toothed wheel integral to the disk are contemplated. However, the positive lock pin 88 of the preferred embodiment provides a fail-safe system, preventing the disk 95 from moving unless the indexing mechanism 60 is actuated.

The primer holder 46 is preferably constructed of high strength plastic, preferably styrene. As seen in FIGS. 4 and 5, the primer holder 46 comprises a disk 95 with a central aperture 94 sized to fit over the hub 78 of the platform 44. Although a disk shape is the preferred embodiment, other shapes are contemplated for use as a primer holder, such as, a straight strip, a rolled strip, an arcuate strip, a hoop, etc. A snap lock ring 96 extending from the lower side of the disk 95 retains the holder on the platform 44 once it has been placed thereon. A small inward protrusion 97 on the tabs 96 fits into an annular depression 77 in the side wall of the central hub 78.

Preferably, as shown in FIG. 3, but omitted from the other figures for clarity, a generally conical cover 98 is placed over the disk to prevent any spent primers not caught by a primer collection chute 164 from landing on the disk. The cover 98 extends substantially over the disk 95 and fits snugly to the outside edge of the platform 44. The snug fit ensures the cover 98 stays in place during reloading yet allows for rapid removal when changing disks 95. A recessed wall 99 of the cover 98 exposes a small area of the disk 95 proximate the primer pocket 102 aligned over the pusher pin 70 to allow the shell plate 54 to contact the disk. The cover 98 preferably comprises a hard transparent barrier so as not to impede viewing of the primers 24 in the disk 95 while preventing spent primers from landing on the disk. The cover 98 also protects a majority of the primers 24 from dust, moisture, oil, coffee, etc. during operation or in situations of extended disuse of the reloader 40. Advantageously, the cover 98 also partially protects the operator from injury due to accidental or negligent combustion of one of the primers 24.

Referring again to FIG. 4, a series of regularly spaced apertures 100 in the top surface forms a ring proximate the edge of the disk 95. The apertures 100 are circular and define primer pockets 102 (FIG. 5) whose walls extend halfway down through the disk to end at shoulders 104. The disk 95 is preferably 0.25 inches thick and the primer pockets 102 extend approximately 0.128 inches down from the top surface of the disk. Primers 24 typically range from 0.125 to 0.128 inches in height, and thus the primer pockets 102 of the present invention are advantageously sized to receive all types of primers. The primer pockets 102 in any one disk 95 accept one of the three different sizes of primers 24. Each primer pocket 102 holds a primer 24 in an interference fit with approximately one-half of one thousandth of an inch difference in the diameters. A pusher pin hole 106 depends downward from the bottom surface of the primer pocket 102 to the bottom face of the disk 95. The pusher pin hole 106 comprises a straight portion 107 and a lower outwardly flared or tapered portion 108. As the disk 95 descends, the pusher pin 70 acts in conjunction with the tapered portion 108 to align the center of the primer pocket 102 over the pin.

As seen in FIGS. 4 and 6, the shell plate 54 mounted on the top end of the piston 52 comprises a generally flat rectangular metal plate which extends across and beyond the piston circumference. A shaft 109 mounted to the support table 42 slides into an aperture 113 in the side of the shell plate 54 opposite the platform 44. A spring 111, disposed around the shaft 109, biases the shell plate 54 and the piston 52 upward from the support table 42 to a "neutral" position with the shell plate a certain distance above the table 42.

A recess 110 in the top of the shell plate 54 opens to one end of the plate, facing the primer holder 46, and includes interior grooves 112 to slidingly receive exterior flanges 114 on the side of a shell receiver 116 (see FIG. 3). The shell receiver 116 comprises a removable inset with a U-shaped slot 118 equipped with an undercut 120 to hold the base flange 37 of an ammunition shell 22. The opposite sides of the slot 118 are parallel, and the inner end circular to conform with the contour of the shell 22. A hole through the bottom of the receiver 116, and concentric with the circular end of the U-shaped slot 118, defines a primer channel 122. The centerline of the primer channel 122 coincides with the centerline of the pusher pin 70. The diameter of the primer channel 122 specifies the particular size of primer 24 allowed to be reloaded, and shell receivers are available for each size of primer. Thus, for example, a shell receiver may accept small pistol shells and have a 0.175 inch diameter primer channel. A second shell receiver may accept large rifle shells and have a 0.211 inch diameter primer channel. In this manner, switching from reloading one variety of shells to the other is simplified by the removable receivers 116. The shell receiver 116 additionally comprises a second larger U-shaped slot 119, located concentrically above the first slot 118, to provide a relief for various reloading tools 160 to extend down far enough around a shell 22 in the receiver 116.

The indexing means 60 for moving the pockets 102 over the pusher pin 70 is shown in FIGS. 8*a–c*. The disk 95 rotates on the stationary platform 44 as a result of its loose fit around the central hub 78. The lock pin 88 normally prevents the disk 95 from rotating when a particular primer pocket 102 is aligned. The indexing means 60 releases the positive lock pin 88 and sequentially aligns the primer pockets 102 over the pusher pin 70 and underneath the primer channel 122 in the shell receiver 116 (see FIG. 7).

The indexing mechanism 60 comprises a lower push rod 124, a lever 126, and a spring-loaded index finger 128. The lower push rod 124 passes through an aperture 130 in the support table 42 to act on a first end 132 of the lever 126. The lever 126 rotates about a lever pivot 134 on a horizontal axis and is biased by a spring 138 holding the lever horizontal. A second end 133 of the lever 126 extends to the opposite side of the lever pivot 134 and may enter a notch 140 in the top of the support table 42. With upward movement of the push rod 124, the first end 132 of the lever 126 similarly moves upward while the second end 133 pivots downward into the notch 140. A flange 151 mounted to a linkage arm 150*a* elevates the push rod 124 upon movement of the operating lever 56.

The index finger 128 pivots about a horizontal pivot 135 in the first end 132 of the lever 126. The lower end of the index finger 128 is connected to an end of the spring 138. The opposite end of the spring 138 is connected to the side of the platform 44, thus urging the lever 126 to lie horizontal. The spring 138 normally holds the index finger 128 vertical, as seen in FIG. 8a, the index finger being restricted from further rotation in a counter-clockwise direction about the index finger pivot 135 by a stop 139 mounted on the lever 126. The positive-lock pin 88 is simultaneously held upward by the second end 133 of the lever 126, opposite the push rod 124, into one of the tapered holes 108 in the bottom of the disk 95. In this regard, both the lever 126 and index finger 128 are biased in the same direction about the lever and index finger pivots, respectively.

A seen best in FIGS. 3 and 4, the lever 126 and index finger 128 swing in a vertical plane tangent to the ring of primer pocket 102 centers in the disk 95, and the index finger aligns within the slot 85, directly below the pockets. The vertical plane is preferably at an acute angle from the line between the piston 52 and pusher pin 70. The acute angle is preferred as the flange 151 and push rod 124 are then located proximate each other, and directly connect with no other coupling necessary. Alternatively, the indexing mechanism 60 may be located distally from the flange 151, and lever 126 and index finger 128 swing in a different plane, with the addition of some connecting linkage. The location and orientation of the indexing mechanism 60 is preferably as shown in the drawings as representative of a prototypical design but other configurations are possible. Similarly, the means for converting the rotation of the operating lever 56 in one plane into rotation of the primer disk 95 in a different plane is shown only as a preferred embodiment, other motion transmitters are deemed equally effective.

As seen in FIG. 8b, upon upward motion of the push rod 124, the lever 126 rotates, pushing the index finger 128 up through slot 85 to extend above the top surface of the platform 44 and contact the lower tapered portion 108 of one of the primer pockets 102. Further rotation of the lever 126 transmits a substantially horizontal force to the tapered portion 108, via the index finger 128, and rotates the disk 95. The second end 133 of the lever 126 pivots down into the support table 42 releasing contact. With the shaft 89 of the positive lock pin 88 and allowing the pin to fall below the surface of the disk 95, or be cammed downward by the tapered portions 108 as the disk 95 rotates.

As the operating lever 56 is then raised, the linkage mechanism 60 allows the push rod 124 to descend, via retreat of flange 151, and the first end 132 is pulled flush with the support table 42 by action of spring 138, as seen in FIG. 8c. As the index finger 128 moves back to its resting position, it pivots slightly in the clockwise direction upon incidental contact with any tapered portions 108. Simultaneously, the second end 133 of the lever 126 pushes the positive lock pin 88 up into a tapered portion 108, again roughly aligning a primer pocket 102 over the pusher pin 70.

The indexing means 60 advantageously frees the operator from manually aligning a new primer 24 over the pusher pin 70. However, the indexing mechanism 60 is only included as a preferred embodiment, the advantages provided by the primer holder 46 of the present invention do not depend on an automatic advance mechanism. Removal of the indexing mechanism 60 and addition of an upward biasing means (not shown) on the positive lock pin 88 would provide a click-stop type of movement of the disk 95, allowing the disk to be manually rotated when desired. Such an arrangement might be preferred by operators desiring complete freedom to align a particular primer pocket 102, such as, for instance, when a shell already has a primer 24 installed and simply requires resizing of the neck. In this case, an empty primer pocket 102 would be aligned underneath the shell to prevent forcing a second primer 24 into the shell. Additionally, the inclusion of a positive lock biasing means (not shown), and separation of the second end 133 and positive lock pin shaft 89, may be incorporated into the preferred embodiment to provide an on-the-spot choice of both automatic and manual advance means.

As seen in FIGS. 2 and 3, the linkage mechanism 60 of the present invention efficiently transmits forces imparted on the operating lever 56 to the piston 52. The linkage mechanism 60 comprises the piston 52, a piston axle 146, a lever block 148, two linkage arms 150a,b, upper and lower linkage arm axles 152, 154 and the operating lever 56. The piston 52 extends down through the cylinder 66 and receives the piston axle 146 into holes at its lower end. Two parallel extensions of the lever block 148 rotate on the piston axle 146 which protrudes from either side of the piston 52. The opposite end of the lever block 148 pivotally couples about the lower axle 154 to the two linkage arms 150a,b on either side. The upper ends of the two linkage arms 150a,b pivotally couple to the cylinder housing 64 about the upper axle 152. The upper axle 152 comprises two colinear stub axles extending from the cylinder housing 64 through the upper end of the linkage arms 150a,b and fixed to the linkage hinges 68. A side member 156 extends from the lever block 148 and the operating lever 56 mounts thereto by welding or other rigid attachment means. All of the elements of the linkage mechanism 60 of the preferred embodiment shown are oriented to swing in parallel planes. The action of the linkage mechanism 60 is such that when the operating lever 56 lowers, the piston 52 raises, elevating the shell plate 54 as well. Conversely, from the lowered position, raising the operating lever 56 lowers the piston 52 and the shell plate 54 onto the disk 95.

The tool plate 50 mounts to the upper portion of the support column 48. The tool plate 50 rotates on a central vertical axis and has one or more threaded apertures (not shown) to receive specialized reloading tools 160. Such tools might include tools for depriming, resizing, shell neck expanding, powder dispensing or bullet seating. The tool plate 50 rotates so that the center of each of the specialized tools 160 aligns directly above the primer channel 122 in the shell receiver 116, and also above the pusher pin 70 and primer pockets 102 in the disk 95. In this manner, when a shell 22 is inserted into the shell receiver 116 the operating lever 56 arm can raise or lower the shell to perform various reloading operations along one axis.

Referring to FIG. 6, the piston comprises a hollow metal tube with an aperture 162 on one side which faces the disk 95. The aperture 162 opens to the interior of the piston directly below the shell receiver 116. The spring-loaded primer chute 164 pivots about the lower edge of the aperture and is spring biased so that its upper end extends outward. As the piston 52 is raised, the primer chute 164 opens up to form a trap door for the primers 24 being pushed out of each shell 22 in the shell receiver 116. The primers 24 fall into the chute 164 and thereafter into the hollow piston 52 wherein a removable bottom (not shown) catches them. As the piston 52 is lowered, the top edge of the primer chute 164 contacts the disk 95 and is pushed back inward until it finally is flush with the piston 52 to fit inside the cylinder 66.

OPERATION

A primer manufacturer fills a disk 95 with a single type of primers 24, the disk satisfies transportation safety requirements and hence it is shipped in that form to the point of purchase. The gun enthusiast buys the primer disk 95 and simply places it on the platform 44 of the reloading machine 40, making sure it snaps into place over the hub 78. A primer pocket 102 is generally aligned over the pusher pin 70, the positive lock pin 88 fitting into the lower side of another pocket ensures this general alignment. The primer pocket 102 could be chosen at random if all the pockets are filled with primers 24, or a particular pocket would be aligned if there are empty pockets. The cover 98 fits over the disk 95 to prevent loose matter from landing thereon. A spent shell 22 with a used primer 24 in its primer socket 30 fits in the shell receiver 116 with the flange 37 of the shell 22 sliding into the U-shaped slot 118 and being held therein by undercuts 120. The operator lowers the operating lever 56 to raise the piston 52 and shell 22 to a depriming tool 160 in the tool plate 50. As the empty shell 22 surrounds the depriming tool 160, a primer removal pin 166 pushes the spent primer 24 out the bottom of the shell 22. The spent primer 24 falls into the open primer chute 164 and into the hollow piston 52, as in the configuration shown in FIG. 6.

The operator then raises the lever 56 which lowers the shell receiver 116 to a neutral position. When the operating lever 56 elevates passed the neutral position, as shown in FIG. 7, the downward moving piston causes the shell plate 54 to push the disk 95 down against the action of the spring 82 on the shaft 74. As the disk 95 lowers, the pusher pin 70 extends above the top surface of the platform 94 into the tapered portion 108 at the bottom of the primer pocket 102. As described above, the primer pockets 102 align over the pusher pin 70 and underneath the primer channel 122 in the shell receiver 116 with the assistance of the tapered portion 108 of the pusher pin hole 106. The new primer 24 is pushed out of the primer pocket 102 and into the primer socket 30 in the bottom of the shell 22. The operator pushes the lever 56 until a substantial resistance force is encountered, indicating the primer 24 has been seated in the socket 30. Subsequent to installing the new primer 24, the operating lever 56 is lowered to push the shell plate 54 upward again to cause the shell 22 to interact with various tools 160 as previously described.

At the upper travel of the piston 52 and shell plate 54 (lowest position of operating lever 56), the linkage arm **150*a* rotates to the vertical position causing flange 151 to contact and raise push rod 124, as seen in FIG. 8*a*. The indexing mechanism 60 is thus activated, and the disk 95 rotated, at the stage where an old primer is pushed from the shell 22. The alignment of a new primer 24 under the shell 22 at this point ensures that the primer socket 30 is emptied. In addition, because the shell plate 54 is raised, a cursory check can be made to see if a primer 24 is aligned properly under the shell 22**.

Referring to the dotted lines in FIG. **8*a*, the flange 151 elevates the push rod 124 which causes the first end 132 of the lever 126 to raise. The second end 133 of the lever 126 pivots into the notch 140 in the table, releasing the barrier to the downward movement of the positive lock pin 88. The lever 126 pushes the index finger 128 up to contact a tapered portion 108 in the bottom of the disk 95, as seen in FIG. 8*b*. The arc of travel of the index finger 128 is such that it pushes the disk 95 slightly farther than required to align the next primer pocket 102, thus ensuring the advancement of the primer pockets. As the disk 95 rotates, if the positive lock pin 88 for any reason sticks within the channel 86, the tapered portion 108 cams the pin down. Upon raising the operating lever 56, the flange 151 releases the push rod 124 which allows the spring 138 to pull the lever 126 back flush with the support table 42. As seen in FIG. 8*c*, the pivoting feature of the index finger 128 allows it to give somewhat from contact with the disk 95 as it travels back to its original position. While the second end 133 of the lever 126 pushes the positive lock pin 88 up into the next tapered portion 108, the chamfered head 90 acts on the tapered sides of the hole to further align the disk 95**.

The improved primer holder and reloading system comprises two mechanisms to insure that the primer pocket 102 is exactly centered over the pusher pin 70. Initially the positive lock pin 88 extending up into the disk 95 locks the disk from rotation. The positive lock pin 88 has some play within the tapered portion 108 in the disk 95 and thus the primer pocket 102 is only generally aligned with the pusher pin 70. When the pusher pin 70 protrudes up through the platform 44, it contacts the tapered portion 108, exactly aligning the primer pocket 102 and primer disk 95 to itself. This fine alignment insures that the primer 24 is pushed straight up through the base 35 of the shell 22 so that it does not enter the shell at an angle.

The primer holder 46 of the present invention embodies major improvements over the prior art. Most importantly, the primers 24 are held in one container from the moment of leaving the factory until they are pressed directly from the container into an empty shell. The primers 24 are securely held within the container and will not fall out upon overturning the container or upon dropping it from a normal height. The dangers associated with extensive handling of the primers 24, as with prior art reloaders, is completely eliminated. Additionally, not handling the primers 24 prevents getting oil or dirt on them.

Advantageously the disk 95 can be removed very rapidly and a new disk with different type of primers 24 installed into the reloading machine 40. It is readily apparent how many primers 24 remain in each disk 95 after its use and switching from one half-full disk to another is facilitated. This advantage is most appreciated by those wanting to experiment with different primers 24. Previously, the primer feed tube had to be removed, emptied and refilled, or a second feed tube filled and used as a replacement.

The disk 95 is aptly suited for instant identification of the particular primers 24 stored within. A product label could be applied on the face of the disk or the plastic dyed a certain color to denote the size, type and manufacture of primer. The disks 95 may be removed from their packaging and stored casually in the workshop without fear of losing track of their identity.

The rigid, non-biodegradable nature of the disk 95 also makes it a suitable candidate for recycling. The old disks could be sent back to the manufacturer where new primers would be inserted into the primer pockets, or the disks sent to a recycling operation to recover the raw material. Alternatively, the disks could be discarded or re-filled by the gun enthusiast and re-used.

Although different size primer pockets 102 exist for primers 24, the pusher pin hole 84 is only one size. Thus, replacing the shell receiver 116 insert is the only reloader adjustment required when changing shell types. This simplifies the operation and ensures that the pusher pin 70 will never jam into a disk. The pusher pin 70 and hole 84 are both approximately 0.174 inches in diameter which is the smallest size of primer 24 available. This means the pusher pin 70 will substantially cover the bottom of small primers 24 and will be exactly in the center of large primers when it pushes upwards.

The inventive concepts of the present invention are not limited to manual single-stage ammunition reloading machines. Alternatively, an automatic shell insertion and retraction device may be incorporated, the operation of the machine thus only requiring cranking of the operating lever 56. Further automation of the machine might eliminate even the cranking step and simply require placing a full primer holder 46 and some sort of shell holder in place on the machine, the shells being de-primed and re-primed automatically upon throwing a switch. The advantageous self-contained nature of the primer holder is well-suited for such future automated embodiments.

Additionally, the inventive concepts described in the specification herein are easily merged into the operation of multiple-stage reloading machines. In place of the shell plate 54 a rotating shell plate with a plurality of shell receivers 116 is contemplated. The rotating shell plate would be raised on the piston 52 to interact with multiple tools on the tool plate 50, providing the multi-stage reloading operation. Current multi-stage reloading devices typically require replacing a finished shell with an empty one, manually positioning a bullet over the shell, and constant monitoring of the primer and powder feed systems and reloading steps (i.e., shell resizing, neck expanding, powder dispensing, bullet seating), all during one crank cycle of the operating lever. Such a device would benefit greatly from the convenient primer holder 46 of the present invention as the extra procedure and oversight required by primer handling systems of the prior art would be eliminated, substantially freeing up the operator to concentrate on the other simultaneous reloading operations. Also, the concepts embodied in the present invention would greatly simplify, and in fact be necessary in, an automated multi-stage reloading device.

While the above description represents the preferred embodiment, the present invention may be embodied in other specific forms without departing from its spirit or essential characteristics.

What is claimed is:

1. An apparatus for installing primers in ammunition shells, comprising a primer holder having walls defining a pocket opening to an upper surface of the holder for receiving a primer, said pocket having a diameter slightly smaller than the diameter of a primer so that there is an interference fit between the pocket and the primer sufficient to prevent the primer from being inadvertently dislodged from the holder during handling of the holder, said holder having a hole extending from a bottom of said pocket to a bottom surface of said holder for receiving a pin which pushes said primer out of said pocket and directly into a shell in response to relative movement between the holder and the pin.

2. The apparatus of claim 1, wherein said holder includes a plurality of said pockets, and a mechanism cooperating with said holder for sequentially moving said holder to move said pockets in alignment with said pin.

3. The apparatus of claim 2, wherein said mechanism includes a finger which enters into said hole and engages a side wall to apply a force for moving said holder.

4. The apparatus of claim 2, including an ammunition shell receiver positioned above and aligned with said pocket, a linkage for raising and lowering said receiver, said holder moving mechanism being responsive to movement of said linkage to move said holder in coordination with movement of said receiver.

5. The apparatus of claim 1, wherein said holder is disk shaped and provided with a plurality of said pockets spaced from each other.

6. The apparatus of claim 1, wherein said hole tapers outwardly in a downwardly direction towards said holder bottom surface so as to facilitate alignment of said holder with said pin.

7. An apparatus for replacing primers in spent ammunition shells, comprising a primer holder having a plurality of spaced pockets formed therein, a primer held in each of said pockets in a manner to prevent the primers from being inadvertently dislodged from the holder during handling of the holder, said holder being constructed to permit said primers to be selectively pushed from said holder and directly into a primer receiving opening in the base of a shell.

8. The apparatus of claim 7, wherein each of said pockets has a bottom wall with a hole formed therein adapted to receive a pin for pushing the primer in said pocket out of the pocket and into said shell.

9. The apparatus of claim 8, including a support table, a support shaft extending upwardly from said table, a platform mounted on said shaft and spaced above said table with said holder positioned on said platform, a spring urging said platform upwardly spaced from said table, a pin mounted in said table and extending upwardly to be axially aligned with one of said pockets, a shell receiver for receiving the base of a shell of a round of ammunition, said receiver being positioned above said holder with a primer receiving opening in said shell being positioned above and axially aligned with one of said pockets and said pin, and means for moving said shell receiver downwardly into engagement with said primer holder, causing said primer holder to be moved downwardly against the urging of said spring and causing one of said holder pocket holes to be moved onto said pin so that one of said primers is pushed out of its pocket and into an opening in the base of a shell positioned in said shell receiver.

10. The apparatus of claim 9, including a piston supporting said shell receiver, a lever and linkage mechanism for raising said piston to a position wherein a primer removal pin enters an open upper end of said shell to push a spent primer downwardly and outwardly of said shell, said piston being further movable downwardly by means of said lever and linkage to lower said shell into engagement with and depress said primer holder to cause a primer to be pushed out of one of said pockets by said pin and into said shell.

11. The apparatus of claim 10, including means responsive to the reciprocating movement of said piston to rotate said disk in sequential steps to position one of said pockets axially aligned with said pin and the primer opening in a shell positioned in said shell receiver.

12. The apparatus of claim 10, wherein said piston contains a spent primer chamber, said piston having a side wall with an inlet formed therein, a chute covering said inlet, said chute being normally urged outwardly on its upper end so as to be open in its upper end, and said chute being pushed to a position where it is closed on its upper end by said holder when said piston is in a lowered position, said inlet and said chute being aligned beneath said shell receiver so that when the piston is elevated to the position where a spent primer is being ejected from said shell, the ejected primer will fall into said chute and be deposited within said chamber.

13. A holder for primers to be installed in the base of a shell for a round of ammunition, comprising a disk having a plurality of pockets, each adapted to receive one of said primers, said pockets being spaced from each other and arranged in a ring near the periphery of the disk, the pockets opening upwardly to the upper surface of the disk, said pockets being dimensioned such that the primers are snugly positioned in the sockets by means of an interference fit such that the primers will not inadvertently fall from the pockets even if the disk is inverted, said primers thereby being individually supported and isolated such that the primers may be shipped in said disk.

14. The holder of claim 13, wherein each of said pockets has a bottom wall with a hole formed therein, with said hole opening to the bottom surface of said disk so that a pin may enter said hole and push a primer from its pocket and directly into an aligned opening in the base of an ammunition shell whereby said disk is not only used as a shipping container but also as a primer holder during installation.

15. A method of shipping, storing and dispensing ammunition primers comprising:

positioning a plurality of primers in a plurality of pockets in a primer holder, with each primer being positioned in its own pocket which is isolated from the other primers, said primer pockets and said primers being dimensioned such that the exterior of the primer has an interference fit with the interior of its pocket so that the primer is held securely within its pocket during shipment, with said primers positioned therein.

16. The method of claim 15, including:

positioning said holder on a support with a shell base receiver positioned above one of said pockets and with a shell positioned in the receiver so that a primer receiver opening in the shell is aligned with a primer in one of said pockets; and pushing one of said primers out of its pocket and directly into said primer receiving opening.

17. A method of dispensing ammunition primers comprising:

positioning a primer holder in a primer installing apparatus, said holder holding a plurality of primers in individual pockets with no other primers above or below each primer and with each primer being captured in its pocket such that a positive force is required to remove the primer from its pocket, said positioning step including positioning the holder so that one of the primers in one of said pockets is aligned with a shell receiver.

18. The method of claim 17, wherein said positioning step includes positioning the holder between said receiver and a primer ejection pin.

19. The method of claim 18, including positioning a shell in said receiver with a bottom of said shell facing said one pocket and with a primer receiving opening in the base of said shell being aligned with said one primer; and producing relative movement between said holder and said pin to cause the primer in said one pocket to be pushed out of its pocket and directly into said shell opening.

20. The method of claim 19, including depressing said holder with said shell receiver so as to depress a primer onto the pin to push the primer out of its pocket directly into the shell.

21. The method of claim 20, including elevating said shell receiver before said movement producing step into a position wherein a spent primer in a shell carried by said receiver is pushed downwardly out of said shell; and lowering said shell receiver, together with shell to engage said primer holder and depress it to a depressed position wherein a new primer is pushed out of said holder into said shell.

22. The method of claim 21, including elevating said shell receiver from said depressed position into a position wherein said holder is allowed to move upwardly from said depressed position in response to the urging of a spring; and automatically advancing said holder in response to movement of said receiver to a position wherein a second primer in said holder is aligned with said shell receiver.

23. The method of claim 21, including opening a chute beneath said shell receiver to capture said spent primer being pushed from said shell, said chute being aligned to direct the spent primer into a chamber within a piston supporting said receiver.

24. The method of claim 17, wherein said holder is in the form of a disk having a ring of spaced pockets located near the periphery of the disk, and said method includes sequentially rotating said disk to position said pockets beneath said shell receiver to install each of said primers into a shell.

25. The method of claim 24, wherein said holder is rotated automatically in response to movement of said shell receiver in connection with an additional shell reloading operation.

* * * * *